US005563367A

United States Patent [19]

Ochi et al.

[11] Patent Number: 5,563,367

[45] Date of Patent: Oct. 8, 1996

[54] PROCESS FOR MANUFACTURING A GAS GENERATOR COMPOSITION

[75] Inventors: Koji Ochi; Kazuyuki Narita; Kazunori Matsuda, all of Aichi-Ken, Japan; Nobukazu Asano, Handa, all of Japan

[73] Assignee: NOF Corporation, Tokyo, Japan

[21] Appl. No.: 409,278

[22] Filed: Mar. 23, 1995

Related U.S. Application Data

[62] Division of Ser. No. 44,281, Apr. 7, 1993, Pat. No. 5,470,406.

[30] Foreign Application Priority Data

| | | | |
|---|---|---|---|
| Apr. 10, 1992 | [JP] | Japan | 4-91245 |
| Aug. 27, 1992 | [JP] | Japan | 4-228834 |
| Dec. 28, 1992 | [JP] | Japan | 4-347836 |

[51] Int. Cl.[6] ..... C06B 45/00

[52] U.S. Cl. ..... 102/288; 102/289; 149/35; 264/3.2

[58] Field of Search ..... 149/35; 102/288, 102/289; 264/3.2

[56] References Cited

U.S. PATENT DOCUMENTS

| | | | |
|---|---|---|---|
| 4,547,235 | 10/1985 | Schneiter et al. | 149/35 |
| 5,019,220 | 5/1991 | Taylor et al. | 264/3.4 |
| 5,070,940 | 12/1991 | Ochi et al. | 149/35 |
| 5,104,466 | 4/1992 | Allard et al. | 149/21 |
| 5,236,526 | 8/1993 | Perotto | 149/17 |
| 5,431,103 | 7/1995 | Hock et al. | 102/287 |
| 5,470,406 | 11/1995 | Ochi et al. | 102/290 X |

FOREIGN PATENT DOCUMENTS

| | | | |
|---|---|---|---|
| 0467731A1 | 1/1991 | European Pat. Off. | C06D 5/06 |
| 2308410 | 11/1976 | France | A62B 35/00 |
| 2663628 | 12/1991 | France | C06D 5/06 |
| 2327741 | 11/1975 | Germany | C06D 5/06 |
| 2410093 | 5/1976 | Germany | C06D 5/06 |
| 2336853 | 8/1976 | Germany | C06D 5/00 |
| 3935869 | 7/1991 | Germany | C06D 5/06 |
| 2236175 | 11/1994 | Germany | C06D 5/06 |
| 58-20920 | 4/1983 | Japan | C06D 5/00 |

OTHER PUBLICATIONS

Chemical Abstracts, vol. 084, No. 16, Apr. 19, 1976, Abstract No. 10799.

Römpp Chemie Lexikon, 9th Edition 1991, pp. 2595, 2596.

*Primary Examiner*—Peter A. Nelson

*Attorney, Agent, or Firm*—Limbach & Limbach

[57] ABSTRACT

The gas generator composition contains sodium azide and an oxidizing agent as major components. This gas generator composition additionally contains 2 to 8% by weight of magnesium aluminate. To produce this composition, sodium azide and the oxidizing agent are admixed to a colloidal silica having a silica concentration of 3 to 15% by weight to form a slurry, followed by granulation and drying of the slurry.

11 Claims, 2 Drawing Sheets

PROCESS FOR MANUFACTURING A GAS GENERATOR COMPOSITION

This is a divisional of application Ser. No. 08/044,281, filed Apr. 7, 1993, now U.S. Pat. No. 5,470,406.

BACKGROUND OF THE INVENTION

This application claims the priority of Japanese Patent Applications Nos. 4-91245 filed on Apr. 10, 1992, 4-228834 filed on Aug. 27, 1992, and 4-347836 filed on Dec. 28, 1992 which are incorporated herein by reference.

FIELD OF THE INVENTION

The present invention relates to a gas generator composition which is to be filled, for example, in a container for gas generator for inflating an air bag of an automobile and a process for manufacturing the same.

DESCRIPTION OF THE RELATED ART

Conventionally known gas generators for inflating an air bag mainly consist of sodium azide and various types of oxidizing agents, and are pelletized. This gas generator is incorporated into a container for gas generator, and generates nitrogen gas when burned. This gas generator is very desirable since it generates only harmless gas when burned.

However, the residue of sodium and sodium compounds, which are by-produced by burning, are harmful. It is therefore desirable that gas generators to be developed have a composition in which the residue by-produced can be converted into harmless substances or chemically change so that they can easily be collected by a "filter mechanism" such as a wire gauze or a filter incorporated into the container for gas generator.

In this respect, some attempts have been made to mix silicon dioxide or the like in the gas generator composition to convert the residue into harmless silicates and, at the same time, into glass with a low melting point, which can easily be collected by a filter mechanism.

For example, Japanese Patent Publication No. 20920/1983 discloses a gas generator consisting of a metal azide and an oxidizing agent. This gas generator contains silicon dioxide or the like which reacts with the by-product residue to form low melting-point glass in order to convert the residue into harmless substances.

U.S. Pat. No. 4,547,235 discloses a composition consisting of 60 to 68% by weight of sodium azide, 18 to 24% by weight of silicon dioxide, 8 to 20% by weight of potassium nitrate, 2 to 20% by weight of molybdenum dioxide and 2 to 4% by weight of sulfur. It is described that the composition is suitable as a gas generator to be put into a container for gas generator, since the residue can easily be collected and the burning rate is controllable.

Further, Japanese Patent Publication No. 1076/1978 describes an example of a gas generator consisting of a fine-grain eutectoid which can be obtained by mixing a fine-grain silicon dioxide with an aqueous solution of a composition containing an azide and a nitrate salt or a perchlorate and then mixing the resulting mixture with a water-soluble organic solvent. It is described that in this composition the residue can effectively be converted into low melting-point glass without impairing combustibility thereof, since the comonents of the composition are homogeneously mixed.

However, the gas generator compositions described in the aforementioned Japanese Patent Publication No. 20920/1983 and U.S. Pat. No. 4,547,235 involve a problem that the silicon dioxide or the like must be incorporated at a high mixing ratio so as to facilitate collection of the residue, resulting in the reduction in the burning rates of the gas generators. To compensate for this, a strong oxidizing agent such as potassium nitrate is needed. However, a gas generator containing such an oxidizing agent as potassium nitrate comes to have a high burning temperature and will generate hot gas. Further, as the mixing ratio of silicon dioxide is large, the mixing ratio of sodium azide decreases accordingly, so that the amount of the gas generator to be put into a single container for gas generator must be increased. As a result, the container becomes heavier and larger.

In addition, when the additive silicon dioxide is reacted with the residue yielded by the reaction between sodium azide and the oxidizing agent, sticky low melting-point glass like sodium silicate is formed. While this low melting-point glass is easily collected by a filter mechanism, it is likely to cause local clogging in the filter mechanism.

Such clogging causes rise in the pressure in the container for gas generator at the time the gas generator is burned. This burning pressure may cause abnormal burning of the gas generator itself. To suppress this phenomenon, the filter mechanism should have a specially designed structure. This measure will complicate the process of manufacturing the container for gas generator. If the filter mechanism is not specially designed, the housing of the container for gas generator should have a pressure resistance high enough to cope with the high burning pressure. This will result in an increase in the size and weight of the container for gas generator and may require some improvement in the manufacturing process.

Meanwhile, the gas generator described in Japanese Patent Publication No. 1076/1978 contains a small amount of silicon dioxide, so that the residue can effectively be collected with not so much drop in the burning rate, advantageously. On the other hand, the ratio of the fine-grain eutectoid obtained by mixing the mixture of fine-grain silicon dioxide, an azide and a nitrate salt or a perchlorate with a water-soluble organic solvent, is less than 70%, and the yield is very low.

SUMMARY OF THE INVENTION

The present invention is accomplished in view of the above problems, and it is a primary object of the present invention to provide a gas generator composition in which the residue can effectively be collected with a small amount of additive while keeping a high burning rate, and there is no fear of increase in the burning pressure even if a specially designed filter mechanism is not used.

It is another object of the present invention to provide a gas generator composition, which can contribute to reduction in the size and weight of the container for gas generator and can be manufactured in high yield, and a process for manufacturing the same.

To achieve the foregoing and other objects and in accordance with the purpose of the present invention, the gas generator composition according to the present invention comprises sodium azide and an oxidizing agent as major components, and 2 to 8% by weight of magnesium aluminate.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

Figure 1:
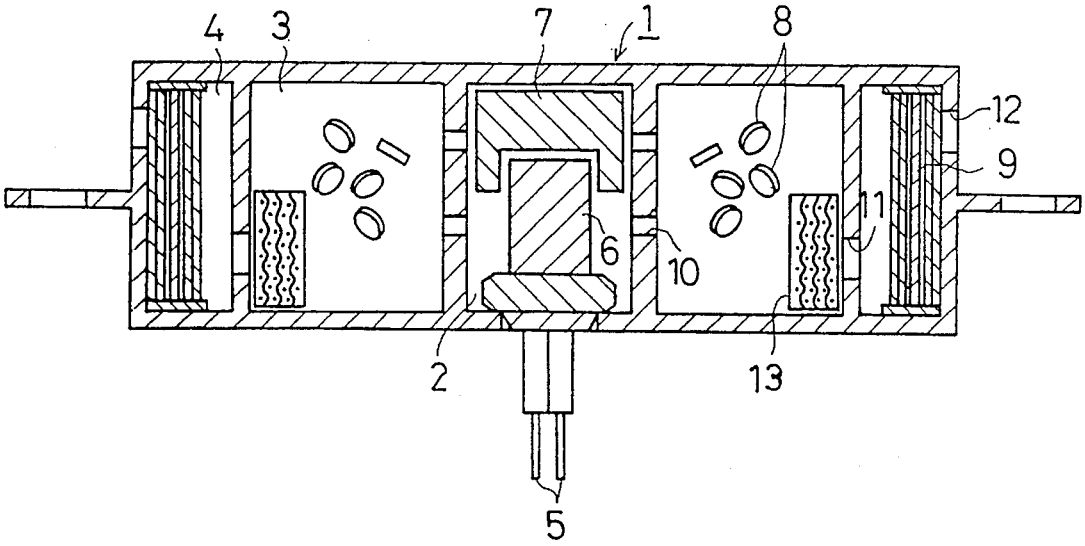
FIG. 1 is a cross section illustrating a container for gas generator which is filled with a gas generator composition of the present invention.

The gas generator composition according to the present invention comprises sodium azide and an oxidizing agent as the major components, and 2 to 8% by weight of magnesium aluminate. Sodium azide is the most typical major component of gas generator that is put in a container for gas generator. The desirable average particle size of sodium azide is 20 μm or smaller in order to acquire a high burning rate.

As the oxidizing agent used together with sodium azide, a conventionally known type is used; for example, a perchlorate such as potassium perchlorate and ammonium perchlorate, a nitrate such as potassium nitrate and sodium nitrate, and a metal oxide such as copper oxide iron oxide and manganese dioxide are used preferably. Among those, manganese dioxide is particularly preferred due to its low burning temperature, high burning rate and good chemical stability when mixed with sodium azide, as well as, its inexpensiveness. The manganese dioxide preferably has a particle size of 10 μm or smaller in order to acquire a high burning rate.

It is well known that sodium azide forms unstable heavy metal azide when mixed or contacted with a heavy metal such as copper and lead. Accordigly, the oxidizing agent or the like which is mixed with sodium azide should contain least possible amount of such heavy metal impurity.

Today, many types of manganese dioxides are manufactured industrially. However, it is desirable that the manganese dioxide to be used according to the present invention should be sufficiently purified, based on the reasons as described above. In the process of purifying manganese dioxide, manganese dioxide is generally reduced temporarily to manganese monoxide which is soluble in sulfuric acid, and then only manganese is selectively oxidized in a sulfuric acid bath. This purification process is preferred in that the heavy metal impurity can be eliminated to the degree of 10 ppm or below. The use of the sulfuric acid bath, however, causes the purified product to inevitably contain 4 to 5% of water, that is adhesive moisture and bonding water.

The gas generator composition containing manganese dioxide, produced through the above purification process, and sodium azide as the major components has a relatively high burning rate and excellent heat stability, but this composition has a disadvantage that the gas formed after burning thereof contains a large amount of harmful ammonia gas.

To overcome this problem, manganese dioxide is preferably baked at 250° to 500° C. for at least two hours. A baking temperature of lower than 250° C. is not preferred, since water cannot be removed sufficiently. If the baking temperature exceeds 500° C., the manganese dioxide is decomposed to be a dimanganese trioxide ($Mn_2O_3$) to release oxygen, although water can almost completely be removed. This dimanganese trioxide works less as the oxidizing agent than manganese dioxide, and cannot provide sufficiently high burning rate when mixed with sodium azide. Thus, the baking temperature above 500° C. is not preferable.

The optimal mixing ratio of the oxidizing agent to sodium azide differs depending on the type of the oxidizing agent in use. The oxidizing agent is suitably added in the range of 25 to 60% by weight, while sodium azide is added in an amount of 40 to 75% by weight.

Magnesium aluminate ($MgAl_2O_4$) in the present invention is prepared in the following manner. With various parameters, such as pH, temperature and stirring rate, determined previously, magnesium aluminate is coprecipitated from an aqueous solution of an aluminum salt and a magnesium salt. The coprecipitation product is washed with water, dried and then pulverized to a desired particle size. The resultant magnesium aluminate preferably has a particle size of 10 μm or smaller.

The content of the magnesium aluminate must be 2 to 8% by weight. If the content of magnesium aluminate is less than 2% by weight, the ratio of magnesium aluminate to the residue to be reacted therewith will be too small to collect the residue sufficiently. Meanwhile, if the content is more than 8% by weight, the burning rate rapidly drops.

When the burning rate is too low, it is necessary to increase the surface area of the pelletized gas generator to compensate for that reduction. To increase the surface area of the pellets forces that the pellets should be made thinner, thus reducing the pellet strength. The pellets, with the reduced pellet strength, may be cracked or broken into pieces when the gas generator container is subjected to strong vibration in an automobile and is exposed to severe environmental condition of a great temperature difference for years. This will result in unexpectedly high pressure in the combustion chamber of the gas generator container when the gas generator is burned.

Further, if the mixing ratio of sodium azide decreases, the amount of the gas generator needed per container increases so as to secure a predetermined amount of sodium azide. This would result in increases in the weight and size of the gas generator container. In view of the above, the mixing amount of magnesium aluminate should fall within the aforementioned range of 2 to 8% by weight.

Figure 2:
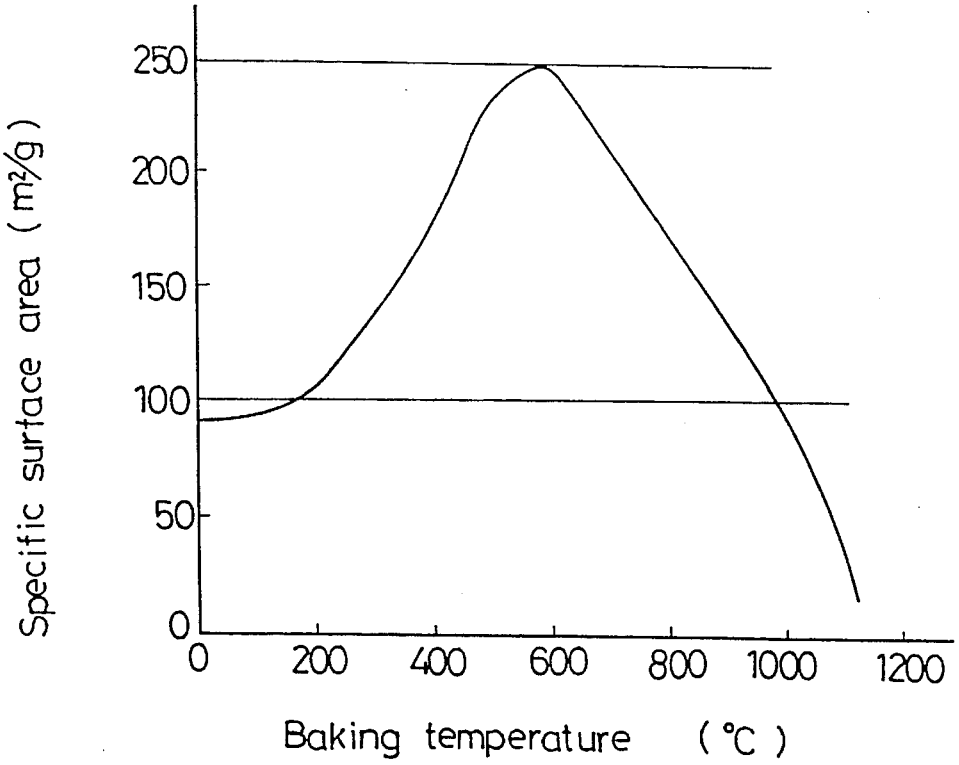
FIG. 2 is a graph showing the relationship between the burning temperature and specific surface area with respect to magnesium aluminate that used in this invention.

Even if magnesium aluminate has a constant particle size, its specific surface area varies greatly depending on the crystal structure. FIG. 2 shows change in the specific surface area when magnesium aluminate with an average particle size of 3.2 μm is baked at different temperatures. A peak in the specific surface appears at a baking temperature in the range of 300° to 900° C. It is considered that this phenomenon occurs because the crystal structure temporarily assumes an amorphous state in the transition from the bialite structure to the spinel structure.

Magnesium aluminate used in the gas generator composition of the present invention exhibits its effect more conspicuously when it is in the amorphous state, i.e., when the specific surface area is 100 to 250 $m^2/g$. This range of the specific surface area is applicable when the particle size of magnesium aluminate is 10 μm or less.

With the specific surface area of less than 100 $m^2/g$, the efficiency of collecting the residue will be low; whereas if it is more than 100 $m^2/g$, the efficiency can be improved significantly. It is difficult to industrially manufacture magnesium aluminate having a specific surface area of greater than 250 $m^2/g$. From the above, the optimal specific surface area of magnesium aluminate ranges from 100 $m^2/g$ to 250 $m^2/g$.

The gas generator composition containing 2 to 8% by weight of magnesium aluminate has the following advantage, besides its high residue collecting efficiency. With the gas generator composition containing 2 to 8% by weight of magnesium aluminate, clogging of the filter mechanism by the residue hardly occures. Therefore, the burning pressure is suppressed to a level lower than that of a composition which contains other additive for residue collection, such as silicon dioxide and silicate salt.

The aforementioned objects of the present invention can be achieved more effectively if the gas generator composition contains 4 to 10% by weight of silica derived from a colloidal silica in addition to sodium azide and an oxidizing agent as the major components, and 2 to 6% by weight of magnesium aluminate.

The colloidal silica is a stable aqueous dispersion of amorphous silica, which has a particle size of about 5 to 100 mμ (1 mμ=1/1000μ). This is obtained by causing silica, formed by hydrolysis or the like of water glass, a silicic acid ester or a silicon halide, to grow to the size of the colloidal dimension.

The amount of colloidal silica to be admixed to the gas generator composition ranges from 4 to 10% by weight in terms of silica or in terms of dry weight when the colloidal silica is dried to be silica. When this mixing amount is less than 4% by weight, the residue cannot be collected sufficiently. On the other hand, with the mixing amount of above 10% by weight, the burning rate suddenly drops and the mixing ratio of sodium azide decreases accordingly, thus increasing the burning pressure as well as raising the aforementioned problems.

The greatest characteristics of the present invention lies in that the combination of magnesium aluminate and colloidal silica, added to the present composition can further improve the residue collecting efficiency while suppressing increase in burning pressure, rather than when either magnesium silica or colloidal silica is used singly. In this case, the total amount of magnesium aluminate and silica in colloidal silica is preferably 6 to 12% by weight and the ratio of the former to the latter is preferably 1:1 to 1:3.

The following is a suitable process for manufacturing the gas generator composition according to the present invention.

To maintain a colloidal silica in a stable state as a sol, pH, concentration, coexisting electrolyte, etc. should be considered. For instance, when a commercially available colloidal silica with the silica concentration of 20 to 40% by weight is merely added to a dry gas generator consisting of sodium azide and an oxidizing agent, the colloidal silica is instantaneously solidified (gelled).

However, according to the present process for manufacturing a gas generator composition, gas generators can be manufactured in a high yield while suppressing this gelation. To accomplish this, first it is necessary to prepare a colloidal silica with a silica concentration of 3 to 15% by weight. Since the concentration of silica in a commercially available colloidal silica generally is 20 to 40% by weight, this colloidal silica is diluted with a deionized water or the like to prepare the aforementioned colloidal silica with a silica concentration of 3 to 15% by weight. In this diluted colloidal silica, the rest of the components to be mixed, namely, sodium azide, an oxidizing agent, and optionally magnesium aluminate are added and blended to provide a substantially homogeneous slurry.

When the silica concentration in the colloidal silica exceeds 15% by weight, the viscosity of the slurry thus prepared rapidly increases to approach a gel state. This decreases the yield of the gas generator composition undesirably. Meanwhile, when the silica concentration in the colloidal silica is below 3% by weight, the slurry readily separates into a solid component and a liquid component. This decreases the yield of the gas generator composition like in the former case and causes variations in the properties undesirably.

To maintain a colloidal silica in a stable sol state, the optimal pH of the slurry ranges from 8 to 10. With a pH of less than 8, the gelation of the slurry easily occurs, undesirably. With a pH of above 10, the colloidal silica becomes a solution of alkali silicate, undesirably.

Within the aforementioned pH range, the surface of each silica particle in the colloidal silica has adsorbed thereon hydroxy ions to be negatively electrified. Therefore, a substance which is positively electrified in water, e.g., ferric oxide, is not basically preferred as the oxidizing agent, since it adversely affects stability of the colloidal silica. This means that a substance, such as manganese dioxide, which is negatively electrified in water within the aforementioned pH range, is preferred.

The gas generator composition of the present invention is homogeneously blended in the form of slurry using, for example, a homogenizer that utilizes a jet stream. The homogenized gas generator composition is pelletized in a later process. To improve the work efficiency in the pelletization, the composition obtained must be granulated and dried. To granulate and dry a slurry gas generator like that of the present invention, it is better to perform spray granulation drying, i.e., to spray the slurry gas generator in a droplet form into a drying column in which hot air is supplied to effect simultaneous granulation and drying of the slurry in a short time. This granulation and drying process can easily be carried out by use of a so-called spray dryer.

In carrying out the manufacturing process of the present invention, first, a given amount of water is supplied into a tank that is used for preparing a gas generator slurry. That amount of water is determined so that the sum of this water and the water in the colloidal silica to be added next will cause the colloidal silica to have a silica concentration of 3 to 15% by weight.

Next, powdery sodium azide, oxidizing agent and magnesium aluminate are added to the water in the tank. Then, the resultant composition is blended using a mixer, such as a homogenizer, to provide a homogeneous slurry. At this time, the order of adding sodium azide, oxidizing agent and magnesium aluminate is not particularly restrictive.

The gas generator slurry thus blended substantially homogeneously is fed into the drying column of the spray dryer by a liquid pump or the like, and is sprayed in a droplet form there through a nozzle or a rotary atomizer. The droplets are granulated and dried during the stay in the drying column, yielding a powder (granule) of gas generator composition.

The particle size of the thus produced gas generator powder is 50 to 300 μm, with the amount of the residual water content being 1% by weight or less. The yield is 90% or above, which is considerably high. The gas generator powder is subjected to compression molding to have the desired shape, e.g., pellet or disk, before it is put into a container for gas generator.

A description will now be given of a container for gas generator in which the gas generator composition of the present invention is put.

As shown in FIG. 1, an igniter chamber 2 is provided at the center in a container for gas generator 1, with a combustion chamber 3 defined to surround the igniter chamber 2. A cooling chamber 4 is further defined concentrically around the combustion chamber 3. A squib 6 connected to leads 5 stands fixed in the igniter chamber 2, with an igniter 7 filled in the upper portion of this chamber 2. A pelletized gas generator composition 8 is charged into the combustion chamber 3, while an annular cooling filter 9 consisting of a wire gauze and an inorganic fiber is disposed in the cooling chamber 4.

Ports 10, 11 are formed to communicate between the igniter chamber 2 and the combustion chamber 3, and between the combustion chamber 3 and the cooling chamber 4, respectively. Exhaust ports 12 are formed around the upper periphery of the cooling chamber 4. Disposed in the combustion chamber 3 at the lower portion is an annular filter 13 facing the ports 11.

When the squib 6 is ignited by the current that is supplied via the lead 5, the igniter 7 is ignited. The flame produced by the ignition intrudes through the ports 10 into the combustion chamber 3. Consequently, the gas generator composition 8 is burned to generate a nitrogen gas. This nitrogen gas passes through the filter 13 and ports 11 into the cooling chamber 4, and is exhausted from the exhaust ports 12 while being cooled through the cooling filter 9. The nitrogen gas thus exhausted then inflates an air bag (not shown).

The gas generator composition according to one aspect of the present invention consists of sodium azide and an oxidizing agent as the major components, and 2 to 8% by weight of magnesium aluminate. Magnesium aluminate reacts with the residue of the burned gas generator composition to form a product with a large particle size, which is considered to have a low stickiness. Therefore, the residue is easily and smoothly collected by the filter mechanism without clogging the filter mechanism.

The gas generator composition according to another aspect of the present invention comprises sodium azide and an oxidizing agent as the major components, 2 to 8% by weight of magnesium aluminate and 4 to 10% by weight of silica derived from a colloidal silica.

Since the colloidal silica assumes a form of active fine grain, it can achieve its purpose sufficiently, if it is added in an amount of 4 to 10% by weight in terms of silica, unlike in the prior art. Most of the residue collected by the filter are converted into harmless substances. Since a predetermined amount of low melting-point glass is produced, it is possible to allow the residue to physically stick on the surface of the glass.

The gas generator composition having incorporated therein both magnesium aluminate and colloidal silica can allow the residue to be filtered more efficiently without increasing the burning pressure than in a gas generator composition having incorporated therein magnesium aluminate alone.

Although magnesium aluminate and colloidal silica are used in the gas generator composition of the present invention, their amounts are small. Thus, the burning rate of the composition hardly drops compared with that of a composition not containing these substances, and the mixing ratio of sodium azide does not decrease so much. Therefore, a strong oxidizing agent, such as a sulfate salt or a perchlorate, should not necessarily be used to compensate for any drop of the burning rate. Further, a large amount of gas is produced.

Furthermore, in the process for manufacturing the gas generator composition according to the present invention, the colloidal silica can be mixed homogeneously with other components without causing gelation. According to this process, a large quantity of gas generator composition can be produced in a high yield by subjecting the composition to spray granulation drying.

EXAMPLES

Examples embodying the present invention will now be described in comparison with comparative examples. In the following description of the individual examples, "% by weight," which is the unit for the amounts of contents of each agent and mixing ratio thereof, will be referred simply as "%."

Example 1

A proper amount of a water/acetone mixture was added to a composition containing 59% of sodium azide, 39% of manganese dioxide and 2% of magnesium aluminate, and the resultant mixture was blended for about 20 minutes by a Shinagawa blender (a product of Kabushiki Kaisha Sanei Seisakusyo.). The resultant wet agent was passed through a 32 mesh silk net to provide a granulated agent with a particle size of about 0.5 mm. After the granulated agent was dried, columnar pellets, 7 mm in diameter and 4 mm in thickness, were produced using a rotary tablet making machine. Incidentally, as the magnesium aluminate, one which had been baked at 400° C. for four hours under an atmospheric environment was used.

About 90 g of the pellets were charged into the combustion chamber 3 of the aforementioned gas generator container 1 shown in FIG. 1. This gas generator container 1 was attached to a 60-liter tank and operated to measure burning pressure and the amount of the residue (sodium) exhausted into the tank. The burning pressure is the pressure in the combustion chamber 3, which was measured by a pressure sensor attached to a mounting hole (not shown) formed in the combustion chamber 3. Further, the burning time was measured from the wave pattern showing change in burning pressure with time.

Figure 3:
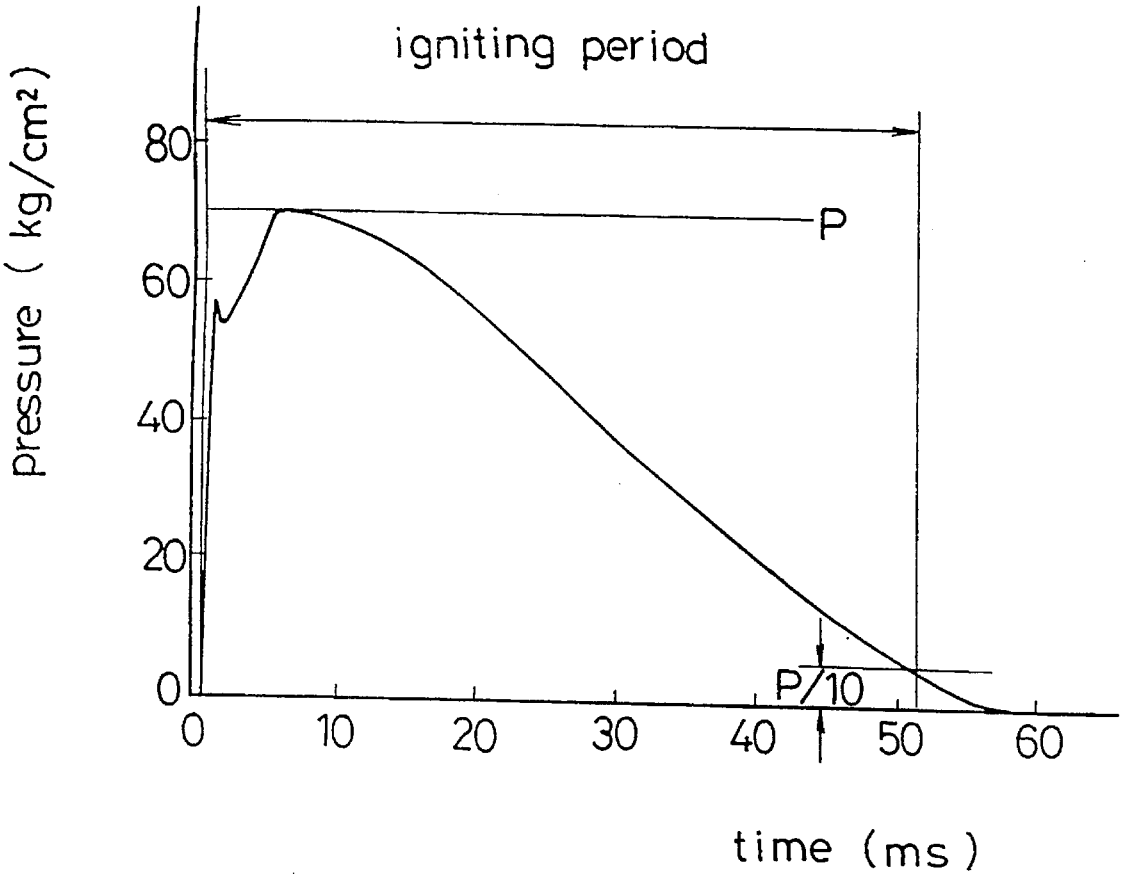
FIG. 3 is a graph showing a burning pressure wave pattern under operation of the container for gas generator and the relationship between the time and the burning pressure.

A typical burning pressure wave pattern is shown in FIG. 3. Referring to FIG. 3, the burning pressure is plotted during the burning period ranging from the beginning of the ignition to the point where the burning pressure dropped to 1/10 the maximum burning pressure P. Table 1 shows the results of the measurement. The amount of the uncollected residue was only 293 mg. The burning pressure was 66 kg/cm$^2$.

As apparent from the above, the magnesium aluminate content of as small as 2% in the gas generator composition of this example reacts well with the residue, and the resulting product has low stickiness. The residue can thus be collected efficiently through the cooling filters 8 and 9 without causing clogging. Accordingly, the burning pressure will not increase even if a specially-designed filter mechanism is not used. In addition, it is possible to secure a sufficient amount of produced gas and to reduce the weight of the gas generator necessary to design a container for gas generator. This contributes to the reduction of the size, weight and manufacturing cost of the gas generator container. Further, the above feature facilitates the manufacturing of the gas generator container.

Due to the low burning pressure, as described above, the pressure resistance performance of the gas generator container can be set to a low level, which also contributes to the weight reduction of the gas generator container.

Examples 2 and 3

In accordance with the compositions of Examples 2 and 3 given in Table 1, gas generator compositions were prepared in the same manner as in Example 1, and the properties of the compositions were evaluated in the same manner as in Example 1. It is to be noted that the amount of pellets charged in the gas generator container was adjusted such that the amount of sodium azide per container may be consistent. Table 1 also shows the results of the evaluation. While the burning pressure is slightly higher than that of Example 1, the amount of the residue is reduced with the increase in the amount of magnesium aluminate added.

Comparative Examples 1 to 3

In accordance with the compositions of Comparative Examples 1 to 3 given in Table 1, gas generator compositions were prepared in the same manner as in Example 1, and the properties of the individual compositions were evaluated in the same manner as in Example 1. It is to be noted that the amount of pellets charged in the gas generator container was adjusted such that the amount of sodium azide per container may be consistent. Table 1 also shows the results of the evaluation. Since magnesium aluminate was added in each comparative Example in an amount out of the range of 2 to 8%, not only a large amount of residue was exhausted, but also the burning time was increased.

In Table 1, a product of Toyo Kasei Kogyo Kabushiki Kaisha (heainafter, Toyo Kasei Kogyo K.K.) was used as the sodium azide. The average particle size of this sodium azide was 9.6 μm. Meanwhile, an electrolytic manganese dioxide "FMH" (trade name, produced by Tosoh K.K.) was used as the manganese dioxide. Further, as the magnesium aluminate, a product of Tomita Seiyaku K.K. was used. The average particle size of the magnesium aluminate was 3.2 μm, and the specific surface area thereof was measured to be 170 $m^2/g$ by the BET method.

Example 4

A proper amount of a water/acetone mixture was added to a composition containing 58% of sodium azide, 34% of manganese dioxide and 8% of magnesium aluminate having a specific surface area of 127 $m^2/g$, and the resultant mixture was blended for about 20 minutes by a Shinagawa blender. The resultant wet agent was passed through a 32 mesh silk net to provide a granulated agent with a particle size of about 0.5 mm. After the granulated agent was dried, columnar pellets, 7 mm in diameter and 3.5 mm in thickness, were produced using a rotary tablet making machine.

About 92 g of the pellets were charged into the combustion chamber 3 of the gas generator container 1 shown in FIG. 1. Thereafter, the amount of the residue and the burning pressure were measured to determine the burning time from the burning pressure wave pattern, in the same manner as in Example 1. Table 2 shows the results of the measurement. The individual physical properties such as the amount of the residue are almost the same as those in Example 2.

Examples 5 and 6

Using the same composition as in Example 4 except that the magnesium aluminate have the specific surface area values (Examples 5 and 6) as shown in Table 2, gas generator compositions were prepared in the same manner as in Example 4 to evaluate the properties of the individual compositions likewise. Table 2 also shows the results of the evaluation. No particular change was observed, except that the amount of the residue was decreased with the increase in the specific surface area.

Comparative Example 4

In accordance with the composition of Example 4 except that the magnesium aluminate had the specific surface area value (Comparative Example 4) as shown in Table 2, a gas generator composition was prepared in the same manner as in Example 4 to evaluate the properties of the composition in the same manner as in Example 4. Table 2 also shows the results of the evaluation. The amount of the residue in Comparative Example 4 is increased compared with those in Examples 4 to 6.

In Table 2, a product of Toyo Kasei Kogyo K.K. was used as the sodium azide. The average particle size of this sodium azide was 9.6 μm. Meanwhile, an electrolytic manganese dioxide "FMH" (trade name, produced by Tosoh K.K.) was used as the manganese dioxide. Further, as the magnesium aluminate, a product of Tomita Seiyaku K.K. was used. The average particle size of the magnesium aluminate was 3.2 μm, and the specific surface area thereof was measured by the BET method.

Example 7

A proper amount of a water/acetone mixture was added to a composition containing 74% of sodium azide, 21% of potassium perchlorate and 8% of magnesium aluminate having a specific surface area of 170 $m^2/g$, and the resultant mixture was blended for about 20 minutes by a Shinagawa blender. The resultant wet agent was passed through a 32 mesh silk net to provide a granulated agent with a particle size of about 0.5 mm. After the granulated agent was dried, columnar pellets, 7 mm in diameter and 4.5 mm in thickness, were produced using a rotary tablet making machine. The sodium azide and magnesium aluminate used here were the same as those of Example 1, and as the potassium perchlorate a product of Nihon Karitto K.K. was used. This potassium perchlorate had an average particle size of 8.8 μm.

About 72 g of the pellets were charged into the combustion chamber 3 of the gas generator container 1 shown in FIG. 1. The procedures of Example 1 were repeated analogously to measure the amount of the residue, the burning pressure and the burning time from the burning pressure wave pattern. As shown in Table 2, the results were excellent: 121 mg of the residue, the burning pressure of 78 $kg/cm^2$ and the burning time of 64 ms.

Comparative Example 5

A proper amount of a water/acetone mixture was added to a composition containing 58% of sodium azide, 34% of manganese dioxide and 8% of silicon dioxide, and the resultant mixture was blended for about 20 minutes by a Shinagawa blender. The resultant wet agent was passed through a 32 mesh silk net to provide a granulated agent with a particle size of about 0.5 mm. After this granulated agent was dried, columnar pellets, 7 mm in diameter and 4.0 mm in thickness, were produced using a rotary tablet making machine. The sodium azide and manganese dioxide used here were the same as those of Example 1, and as the silicon dioxide "AEROSIL-R972," a product of Nippon Aerosil K.K. was used.

About 92 g of the pellets were charged into the combustion chamber 3 of the gas generator container 1 shown in FIG. 1. The procedures of Example 1 were repeated analogously to measure the amount of the residue, the burning pressure and the burning time. Although the results were excellent: 130 mg of the residue and the burning time of 59 ms, as shown in Table 2, the burning pressure was 106 kg/cm$^2$, which is higher than those of Examples.

Comparative Example 6

A proper amount of a water/acetone mixture was added to a composition containing 58% of sodium azide, 34% of manganese dioxide and 8% of magnesium aluminate silicate, and the resultant mixture was blended for about 20 minutes by a Shinagawa blender. The resultant wet agent was passed through a 32 mesh silk net to provide a granulated agent with a particle size of about 0.5 mm. After the granulated agent was dried, columnar pellets, 7 mm in diameter and 4.0 mm in thickness, were produced using a rotary tablet making machine. The sodium azide and manganese dioxide used here were the same as those of Example 1. Further, as the magnesium aluminate silicate a product of Tomita Seiyaku K.K. was used. The average particle size of the magnesium aluminate silicate was 2.8 μm.

About 92 g of the pellets were charged into the combustion chamber 3 of the gas generator container 1 shown in FIG. 1. The procedures of Example 1 were repeated analogously to measure the amount of the residue, the burning pressure and the burning time. Although the results were excellent: 151 mg of the residue and the burning time of 62 ms, as shown in Table 2, the burning pressure was 103 kg/cm$^2$, which is higher than those of Examples.

Example 8

A 40% colloidal silica was introduced to a container containing a given amount of deionized water and diluted thereby to prepare a 4% colloidal silica. To the colloidal silica thus prepared were added predetermined amounts of sodium azide, manganese dioxide and magnesium aluminate. The ratio of sodium azide/manganese dioxide/magnesium aluminate/colloidal silica is as shown in Table 3. The resulting mixture was blended with a homogenizer to provide a homogeneous slurry. This slurry was then subjected to spray granulation and drying using a two-fluid type spray dryer to provide a granulated agent with an average particle size of about 100 μm. The yield was about 97%. Pellets of 7 mm in diameter and 4.9 mm in thickness were produced from the granulated agent using a rotary tablet making machine. After 92 g of the pellets were charged into the gas generator container 1 shown in FIG. 1, the container was mounted to a 60-liter tank tester to determine burning pressure and the amount of sodium discharged into the gas generator container during the operation.

On the other hand, a rod-like molded product (hereinafter referred to as "strand") having a size of 5 mm×8 mm×50 mm was prepared from the aforementioned granulated agent using a special mold and a manual type hydraulic pressing machine. The burning rate was determined in the following manner. The cylindrical surface of the strand was coated with an epoxy resin to prevent burning over the entire surface, and two small holes were formed therein at a proper interval in the longitudinal direction using a 0.5 mm-diameter drill, in which fuses for measuring the igniting time were inserted. This strand sample was set on a given mount and was ignited via a nichrome wire at one end thereof under a pressure of 30 atm, and the instant that fusing occurred at the time the burning surface passed by the fuses was measured electrically. The distance between the two holes was divided by the time difference to obtain a linear burning rate. Table 3 shows the result of the measurement.

Examples 9 to 13

In accordance with the compositions of Examples 9 to 13 given in Tables 3 and 4, gas generator compositions were prepared in the same manner as in Example 8 to evaluate properties of the individual compositions in the same manner as in Example 8. It is to be noted that the concentration of the diluted colloidal silica was adjusted to 3 to 15% and that the amount of pellets charged in the gas generator container was adjusted such that the amount of sodium azide per container may be consistent. The pellet thickness was adjusted to the values as shown in Table 3 in accordance with the respective burning rates. Tables 3 and 4 show the results of the evaluation.

Example 14 and Comparative Examples 7 to 11

In accordance with the compositions of Example 14 and Comparative Examples 7 to 11 given in Tables 3 and 4, gas generator compositions were prepared in the same manner as in Example 8 to evaluate the properties of the individual compositions in the same manner as in Example 8. The ratio of the solid content to water in the gas generator slurry was kept at 1:1 in terms of weight ratio, so that the resultant concentration of the diluted colloidal silica was 0 to 12%. It is to be noted that the amount of pellets charged in the gas generator container was adjusted such that the amount of sodium azide per container may be consistent. The pellet thickness was adjusted to the values as shown in Tables 3 and 4 in accordance with the respective burning rates. Tables 3 and 4 show the results of the evaluation.

In Tables 3 and 4, a product of Toyo Kasei Kogyo K.K., Ltd. with an average particle size of was 9.6 μm was used as the sodium azide, while an electrolytic manganese dioxide "FMH" (trade name, produced by Tosoh K.K.) which was baked at 400° C. for three hours in an electric furnace under an atmospheric environment, was used as the manganese dioxide. Further, as the magnesium aluminate, a product of Tomita Seiyaku K.K. was used. The average particle size of the magnesium aluminate was 3.2 μm, and the specific surface area thereof was measured to be 170 m$^2$/g by the BET method. "Snowtex 40 (40% solution)", a product of Nissan Kagaku Kogyo K.K. was used as the colloidal silica. The ratios of silica in the tables are calculated in terms of silicic anhydride.

It is apparent from Tables 3 and 4 that when the amount of silica is increased while the amount of magnesium aluminate is kept constant, the amount of sodium to be discharged decreases and the pressure increases (see Examples 8, 9, 10 and 13 and Comparative Examples 9 and 10). When the content of silica exceeds 10%, the pressure jumps up too high to be suitable for practical use (see Comparative Example 9). With the silica content of less than 4%, the amount of sodium to be discharged rapidly increases, which is not suitable for practical use (see Example 10 and Comparative Example 10). When the content of the magnesium aluminate is less than 2%, the amount of sodium to be discharged increases. The magnesium aluminate can be used suitably in an amount of 8% or less.

Example 14

A 40% colloidal silica was introduced to a container containing a given amount of deionized water and diluted thereby to prepare a 6% colloidal silica. To the colloidal silica thus prepared were added predetermined amounts of sodium azide, manganese dioxide and magnesium aluminate. The ratio of sodium azide/manganese dioxide/magnesium aluminate/silica is as shown in Table 5. The resulting mixture was blended by stirring in a homogenizer to provide a homogeneous slurry. This slurry was then subjected to spray granulation and drying using a two-fluid nozzle type spray dryer to provide a granulated agent with an average particle size of 90 μm. The yield was about 95%. Pellets of 7 mm in diameter and 4.8 mm in thickness were produced from this granulated agent using a rotary tablet making machine.

After 77 g of the pellets were charged into the gas generator container 1 shown in FIG. 1, the container was mounted to a 60-liter tank tester to determine burning pressure and the amount of sodium discharged into the tank during the operation of the gas generator container. On the other hand, a strand having a size of 5 mm×8 mm×50 mm was prepared from the aforementioned granulated agent using special mold and a manual type hydraulic pressing machine. The burning rate was determined as the linear burning rate in the same manner as in Example 8. Table 5 shows the result of the measurement.

Example 15

In accordance with the composition of Example 15 given in Table 5, a gas generator composition was prepared in the same manner as in Example 14 to evaluate the properties of the individual compositions in the same manner as in Example 14. It is to be noted that the concentration of the diluted colloidal silica was adjusted to 4% and that the pellet thickness was adjusted to 4.5 mm. Table 5 shows the results of the evaluation.

Comparative Examples 12 and 13

In accordance with the compositions of Comparative Examples 12 and 13 given in Table 5, gas generator compositions were prepared in the same manner as in Example 14 to evaluate the properties of the individual compositions in the same manner as in Example 14. The ratio of the solid content to water in the gas generator slurry was kept at 1:1 in terms of weight ratio, so that the resultant concentrations of the diluted colloidal silica were 8% and 0%, respectively. The pellet thickness was adjusted to the values as shown in Table 5 in accordance with the respective burning rates. Table 5 shows the results of the evaluation and adjustment.

When the sodium azide content is as large as 71% and either magnesium aluminate or silica is added, the amount of sodium to be discharged increases, which is not suitable for practical use.

In Table 5, a product of Toyo Kagaku Kogyo K.K. with an average particle size of 70 μm was used as sodium azide. Meanwhile, a product of Nihon Karitto K.K. which had been passed through a 250 mesh was used as the potassium perchlorate. Further, the same magnesium aluminate and colloidal silica as used in Example 1 were also used.

Example 16

A 40% colloidal silica was introduced to a container containing a given amount of deionized water and diluted therein to prepare a 3% colloidal silica. To the colloidal silica thus prepared were added predetermined amounts of sodium azide, manganese dioxide and magnesium aluminate. The ratio of sodium azide/manganese dioxide/magnesium aluminate/silica is as shown in Table 6. The resulting mixture was blended by stirring in a homogenizer to provide a homogeneous slurry. This slurry was then subjected to spray granulation and drying using a two-fluid nozzle type spray dryer to provide a granulated agent with an average particle size of 100 μm. The yield was about 97%, which is shown in Table 6. The raw materials used were the same as those of Example 8.

Examples 17 to 19 and Comparative Examples 14 to 17

In accordance with the compositions of Examples 17 to 19 given in Table 6, gas generator compositions were prepared in the same manner as in Example 16 to determine yields. It is to be noted that the concentrations of the diluted colloidal silica were adjusted to the values as shown in Table 6. The results of measurement are as shown in Table 6.

It is apparent from Table 6 that when the concentration of silica in colloidal silica is changed while the composition of the gas generator is kept constant, the yield of the gas generator decreased within the silica concentration range of 3% to 15%.

TABLE 1

| Example or Comp. Example | Gas generator composition (%) | | | A- | | |
|---|---|---|---|---|---|---|
| | Sodium azide | Manganese dioxide | Magnesium aluminate | mount of residue (mg) | Burning pressure (kg/cm$^2$) | Burning time (ms) |
| Comp. Ex. 1 | 60 | 40 | 0 | 1087 | 64 | 50 |
| Comp. Ex. 2 | 60 | 39 | 1 | 720 | 66 | 52 |
| Ex. 1 | 59 | 39 | 2 | 293 | 66 | 52 |
| Ex. 2 | 57 | 38 | 5 | 129 | 71 | 55 |
| Ex. 3 | 55 | 37 | 8 | 45 | 71 | 62 |
| Comp. Ex. 3 | 54 | 36 | 10 | 21 | 78 | 83 |

TABLE 2

| Example or Comp. Example | Gas generator composition (%) Sodium azide | Magnesium dioxide | Magnesium aluminate | Specific surface area of magnesium aluminate ($m^2/g$) | Amount of residue (mg) | Burning pressure ($kg/cm^2$) | Burning time (ms) |
|---|---|---|---|---|---|---|---|
| Ex. 4 | 58 | 34 | 8 | 127 | 182 | 73 | 63 |
| Ex. 5 | 58 | 34 | 8 | 196 | 60 | 75 | 64 |
| Ex. 6 | 58 | 34 | 8 | 245 | 39 | 79 | 64 |
| Comp. Ex. 4 | 58 | 34 | 8 | 32 | 405 | 68 | 66 |
| Comp. Ex. 5 | 58 | 34 | 8* | — | 130 | 106 | 59 |
| Comp. Ex. 6 | 58 | 34 | 8** | — | 151 | 103 | 62 |
| Ex. 7 | 74 | 21*** | 8 | 170 | 121 | 78 | 64 |

*Silicon dioxide
**Magnesium aluminate siliate
***Potassium perchlorate

TABLE 3

| Example and Comp. Example | CE 7 | E 8 | E 9 | E 13 | E 11 |
|---|---|---|---|---|---|
| Gas generator composition (%) | | | | | |
| Sodium azide | 59 | 59 | 58 | 56 | 56 |
| Manganese dioxide | 35 | 35 | 34 | 32 | 32 |
| Magnesium aluminate | 0 | 2 | 2 | 2 | 3 |
| Silica | 6 | 4 | 6 | 10 | 9 |
| Strand burning rate (mm/sec) | 50 | 49 | 46 | 39 | 38 |
| Pellet thickness (mm) | 5.0 | 4.9 | 4.6 | 3.9 | 3.8 |
| Amount of sodium discharged (mg) | 160 | 89 | 44 | 13 | 8 |
| Burning pressure ($kg/cm^2$) | 84 | 62 | 78 | 101 | 95 |

E: Examples 8–14
CE: Comparative Examples 7–10

TABLE 4

| Example and Comp. Example | CE 10 | E 10 | CE 9 | CE 8 | E 12 | E 14 |
|---|---|---|---|---|---|---|
| Gas generator composition (%) | | | | | | |
| Sodium azide | 59 | 58 | 54 | 59 | 56 | 55 |
| Manganese dioxide | 35 | 34 | 30 | 35 | 32 | 31 |
| Magnesium aluminate | 4 | 4 | 4 | 6 | 6 | 8 |
| Silica | 2 | 4 | 12 | 0 | 6 | 6 |
| Strand burning rate (mm/sec) | 48 | 42 | 21 | 46 | 36 | 24 |
| Pellet thickness (mm) | 4.8 | 4.2 | 2.1 | 4.6 | 3.6 | 2.4 |
| Amount of sodium discharged (mg) | 131 | 33 | 20 | 147 | 7 | 6 |
| Burning pressure ($kg/cm^2$) | 61 | 70 | 124 | 56 | 83 | 90 |

TABLE 5

| Example and Comp. Example | E 14 | E 15 | CE 12 | CE 13 |
|---|---|---|---|---|
| Gas generator composition (%) | | | | |
| Sodium azide | 71 | 71 | 71 | 71 |

TABLE 5-continued

| Example and Comp. Example | E 14 | E 15 | CE 12 | CE 13 |
|---|---|---|---|---|
| Manganese dioxide | 21 | 21 | 21 | 21 |
| Magnesium aluminate | 2 | 4 | 0 | 8 |
| Strand burning rate (mm/sec) | 48 | 45 | 49 | 33 |
| Pellet thickness (mm) | 4.8 | 4.5 | 4.9 | 3.3 |
| Amount of sodium discharged (mg) | 88 | 95 | 175 | 167 |
| Burning pressure ($kg/cm^2$) | 85 | 80 | 119 | 71 |

TABLE 6

| Example and Comp. Example | CE 14 | E 16 | E 17 | CE 16 | CE 15 | E 18 | E 19 | CE 17 |
|---|---|---|---|---|---|---|---|---|
| Gas generator composition (%) | | | | | | | | |
| Sodium azide | 57 | 57 | 57 | 57 | 56 | 56 | 56 | 56 |
| Manganese dioxide | 33 | 33 | 33 | 33 | 32 | 32 | 32 | 32 |
| Magnesium aluminate | 6 | 6 | 6 | 6 | 2 | 2 | 2 | 2 |
| Silica | 4 | 4 | 4 | 4 | 10 | 10 | 10 | 10 |
| Concentration of silica in colloidal silica (%) | 2 | 3 | 15 | 17 | 2 | 3 | 15 | 17 |
| Yield (%) | 83 | 97 | 94 | 80 | 82 | 97 | 92 | 78 |

What is claimed is:

1. A process for producing a gas generator composition comprising the steps of:

adding sodium azide, an oxidizing agent and magnesium aluminate to a colloidal silica having a silica concentration of 3 to 15% by weight and blending the resultant mixture to form a slurry; and granulating and drying said slurry to provide a gas generator composition.

2. The process according to claim 1, wherein pH of said slurry is 8 to 10.

3. The process according to claim 1, wherein said oxidizing agent is a substance which is negatively charged in said slurry.

4. The process according to claim 1, wherein said oxidizing agent is manganese dioxide.

5. The process according to claim 1, wherein said oxidizing agent is manganese dioxide baked at 250° to 500° C.

6. The process according to claim 1, wherein the ratio of silica derived from colloidal silica to said gas generator composition is 4 to 10% by weight.

7. The process according to claim 1, wherein the ratio of said magnesium aluminate to said gas generator composition is 2 to 6% by weight.

8. The process according to claim 1, wherein said magnesium aluminate has a specific surface area of 100 to 250 $m^2/g$.

9. The process according to claim 1, wherein the ratio of silica derived from colloidal silica to said gas generator composition is 4 to 10% by weight and a ratio of said magnesium aluminate to said gas generator composition is 2 to 8% by weight.

10. The process according to claim 1, wherein the total amount of said magnesium aluminate and said silica derived from colloidal silica is 6 to 12% by weight.

11. The process according to claim 1, wherein an adding ratio of said magnesium aluminate to said silica derived from colloidal silica is 1:1 to 1:3 in terms of weight ratio.

* * * * *

UNITED STATES PATENT AND TRADEMARK OFFICE

CERTIFICATE OF CORRECTION

PATENT NO. : 5,563,367
DATED : October 8, 1996
INVENTOR(S) : KOJI OCHI ET AL.

It is certified that error appears in the above-indentified patent and that said Letters Patent is hereby corrected as shown below:

In Col. 15, line 61 through Col. 16, please replace Table 5 to read

| Example and Comp. Example | | E 14 | E 15 | CE 12 | CE 13 |
|---|---|---|---|---|---|
| Gas generator composition (%) | Sodium azide | 71 | 71 | 71 | 71 |
| | Manganese dioxide | 21 | 21 | 21 | 21 |
| | Magnesium aluminate | 2 | 4 | 0 | 8 |
| | Silica | 6 | 4 | 8 | 0 |
| Strand burning rate (mm/sec) | | 48 | 45 | 49 | 33 |
| Pellet thickness (mm) | | 4.8 | 4.5 | 4.9 | 3.3 |
| Amount of sodium discharged (mg) | | 88 | 95 | 175 | 167 |
| Burning pressure (kg/cm$^2$) | | 85 | 80 | 119 | 71 |

Signed and Sealed this

Twenty-fifth Day of February, 1997

*Attest:*

Bruce Lehman

BRUCE LEHMAN

*Attesting Officer*

*Commissioner of Patents and Trademarks*